US006942531B1

(12) United States Patent
Fell et al.

(10) Patent No.: US 6,942,531 B1
(45) Date of Patent: Sep. 13, 2005

(54) JOY STICK CONTROL SYSTEM FOR A MODIFIED STEERING SYSTEM FOR SMALL BOAT OUTBOARD MOTORS

(76) Inventors: William P. Fell, 549 W. Fireweed La., Anchorage, AK (US) 99503; William P. O'Hara, P.O. Box 521311, Big Lake, AK (US) 99652

( * ) Notice: Subject to any disclaimer, the term of this patent is extended or adjusted under 35 U.S.C. 154(b) by 0 days.

(21) Appl. No.: 10/783,931

(22) Filed: Feb. 20, 2004

Related U.S. Application Data

(63) Continuation-in-part of application No. 10/696,418, filed on Oct. 29, 2003.

(51) Int. Cl.[7] ..... B60K 41/00
(52) U.S. Cl. ..... 440/84; 440/86; 440/87
(58) Field of Search ..... 440/38, 39, 40, 440/41, 42, 43, 84, 86, 87

(56) References Cited

U.S. PATENT DOCUMENTS 3,209,534 A * 10/1965 Stallman ..... 60/222
6,230,642 B1 * 5/2001 McKenney et al. ..... 114/150
6,234,853 B1 * 5/2001 Lanyi et al. ..... 440/53
6,342,775 B1 * 1/2002 Sleder, Sr. ..... 320/116
6,511,354 B1 * 1/2003 Gonring et al. ..... 440/87

FOREIGN PATENT DOCUMENTS

GB 2172866 A * 10/1986

* cited by examiner

*Primary Examiner*—Stephen Avila
(74) *Attorney, Agent, or Firm*—Michael J. Tavella

(57) ABSTRACT

A joystick controller for modified steering system for boats with outboard motors. The system uses a directional nozzle for the jet output that is attached to a control cable system. This cable turns the directional nozzle, which causes the trust of the jet output to turn the boat. Thus, the boat can be steered without having to turn the entire motor. The system also has a reversing cup to change direction. The system uses a joystick that connects to a set of actuators, which in turn, connect to the directional nozzle, reverse cup and throttle. In this way, the joystick can control the movement of the boat in any direction. The joystick can be used with a conventional motor as well.

3 Claims, 14 Drawing Sheets

JOY STICK CONTROL SYSTEM FOR A MODIFIED STEERING SYSTEM FOR SMALL BOAT OUTBOARD MOTORS

CROSS REFERENCE TO RELATED APPLICATIONS

This is a continuation in part of application Ser. No. 10/696,418, filed on Oct. 29, 2003, now copending.

STATEMENT REGARDING FEDERALLY SPONSORED RESEARCH AND DEVELOPMENT

Not Applicable

BACKGROUND OF THE INVENTION

1. Field of the Invention

This invention relates to jet powered steering system for small boat outboard motors and particularly to jet powered steering system for small boats that steer without turning the outboard motor.

2. Description of the Prior Art

Outboard motors have been in use decades. These units have a small engine that is attached to a drive shaft, which in turn, drives a propeller or jet drive. The output of these motors propels the boat forward. To turn the boat, the user must guide the output of the motor to one side of the stern. This is typically accomplished in one of two ways. The first uses a tiller arm that is directly attached to the motor. This system is usually found on smaller motors. It has an extended handle, usually with a throttle grip attached. The motor is secured to the transom of the boat on a pivot that allows the motor to be rotated about the pivot. This is done by moving the tiller handle from side to side. For larger boats, a steering wheel system is often used. The steering wheel is typically located forward in the boat and is connected to the motor by cables. As the steering wheel is turned, the steering wheel pulls the cables, which in turn, cause the motor to pivot about its pivot, thereby steering the boat.

The problem with this system is that it requires the entire motor to move. Besides the effort needed to move the motor, the amount the motor can turn is often limited by the space behind the transom. Moreover, turning the motor from one side of the boat to the other takes some time, especially for the steering wheel controls.

BRIEF DESCRIPTION OF THE INVENTION

The instant invention overcomes this problem by creating a directional nozzle for the jet output that is attached to a control cable system. This cable causes the directional nozzle to turn, which causes the trust of the jet output to turn the boat. Thus, the boat can be steered without having to turn the entire motor. Two different mechanisms are disclosed that enable the steering. The first is a tiller system that operates much like the traditional tiller on an outboard motor. However, unlike those tillers, this tiller operates the directional nozzle and does not turn the entire motor. The second mechanism is a bicycle handlebar system that is placed forward of the motor, much like a traditional wheel. The handlebar system, when combined with the new steering system, produces faster steering response without the effort required to turn the wheel to make large sweeping turns.

Finally, a joystick controller can also be used with this system—or a conventional outboard motor, where the entire motor turns.

The system has a substantial advantage over standard steering systems. First, is speed of control. The boat turns much faster because the movement of the steering control is minimized. Second, the operation of the boat is optimized because the motor remains stationary, which helps maintain optimum water flow under the boat.

DETAILED DESCRIPTION OF THE INVENTION

Figure 1:
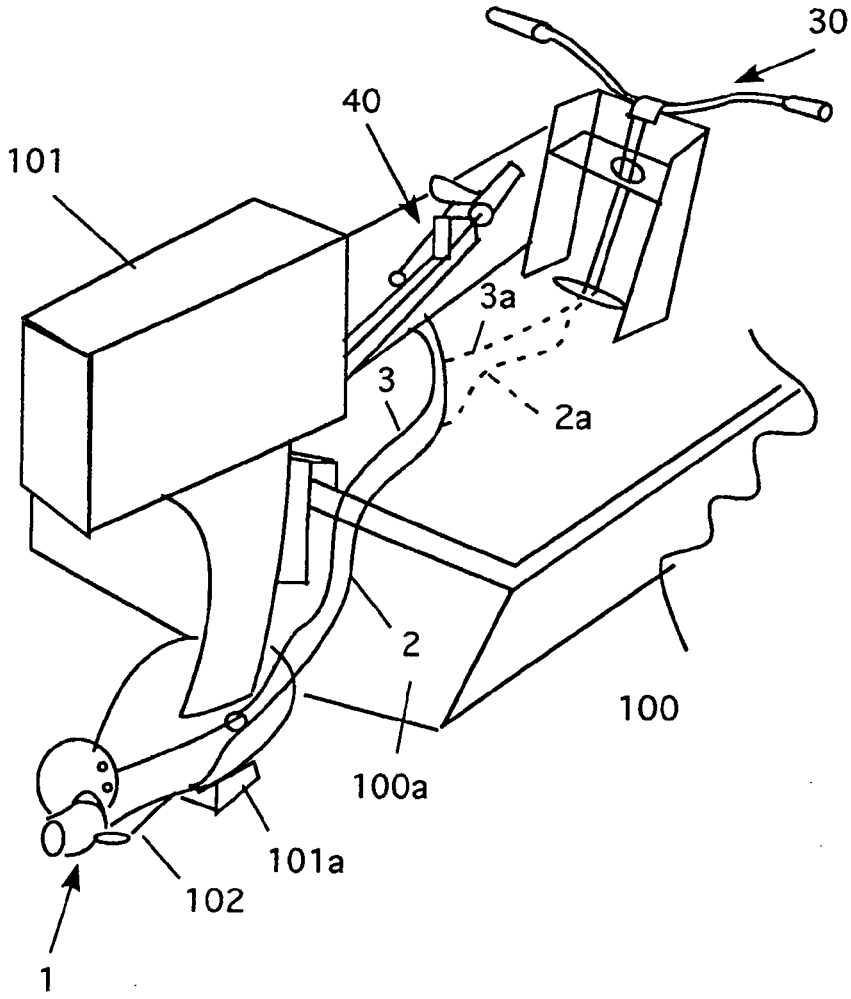
FIG. 1 is a detail view of the first embodiment of the invention, the jet pump steering system.

Referring now to FIG. 1, a detail view of the invention, the jet pump steering (JPS) system is shown. FIG. 1 shows a portion of a boat 100 that has a transom 100*a* on which an outboard motor 101 is mounted. The motor 101 has a jet pump drive 102 (see FIG. 2) on its lower unit 101*a*. The figure shows the JPS system 1 mounted to the lower unit 101*a* of the motor 101. Control cables 2 and 3 are shown running from the JPS system 1 to the control tiller 30. Dashed lines 2*a* and 3*a* are shown running to the optional handlebar steering system 40. Both the control tiller and the handlebar steering system are discussed in greater detail below.

Figure 2:
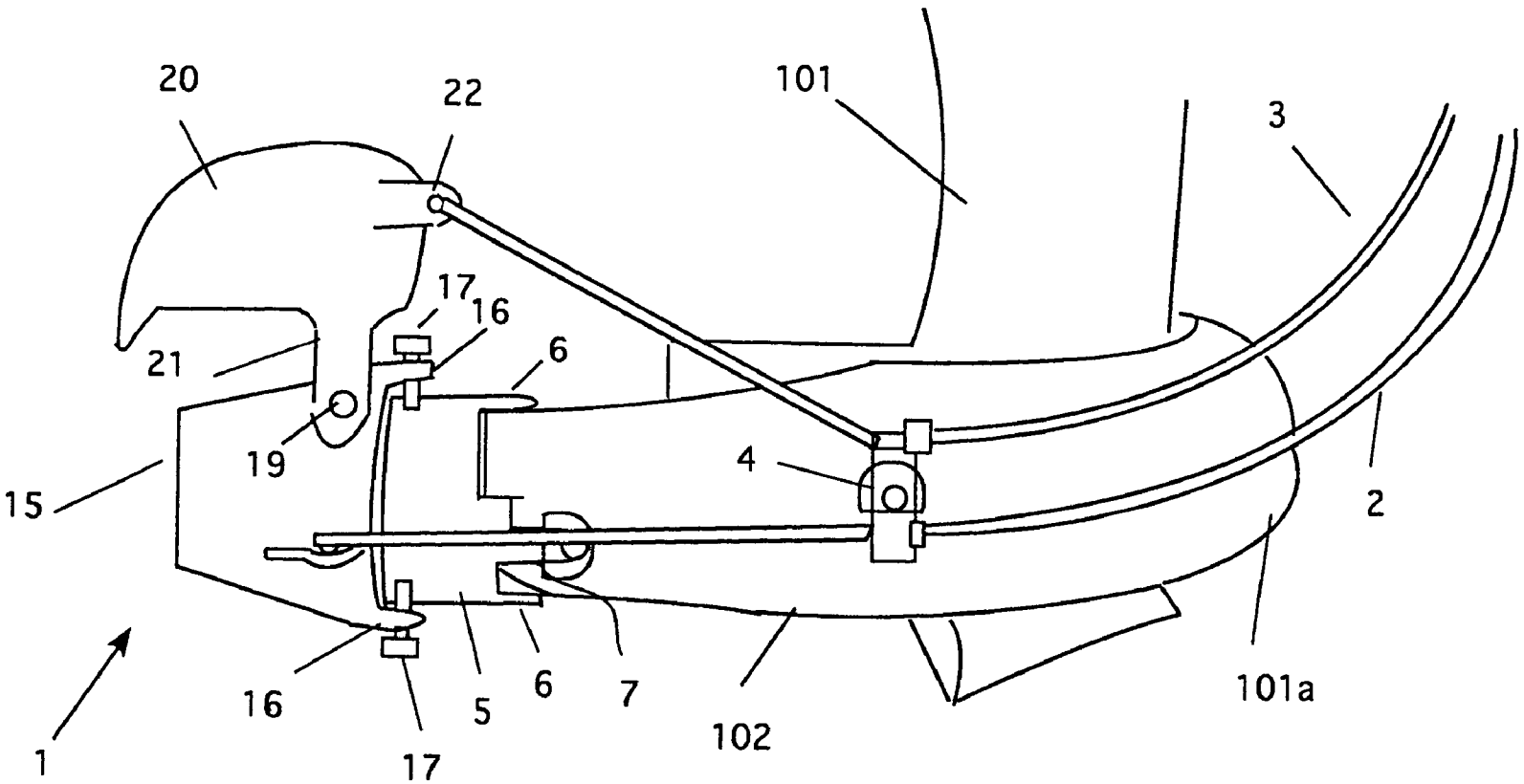
FIG. 2 is a side detail view of the jet pump steering system lower portion.

FIG. 2 is a side detail view of the JPS system 1. Here, the lower unit 101*a* of the motor 101 is shown. The jet pump output 102 extends out from the back of the lower unit 101*a*. The JPS has three main parts. First, there is an adaptor ring 5 (see FIG. 4). Next, there is a directional nozzle 15 (see FIG. 5) and then there is a reverse thrust cap 20 (see FIG. 6). When assembled, these components allow a user to steer a boat quickly and easily. Cables 2 and 3 are shown attaching to the directional nozzle 15 and to the reverse thrust cap 20. These connections are described in detail below. The cables also are held by bracket 4, which is secured to the lower unit 101*a*.

Figure 3:
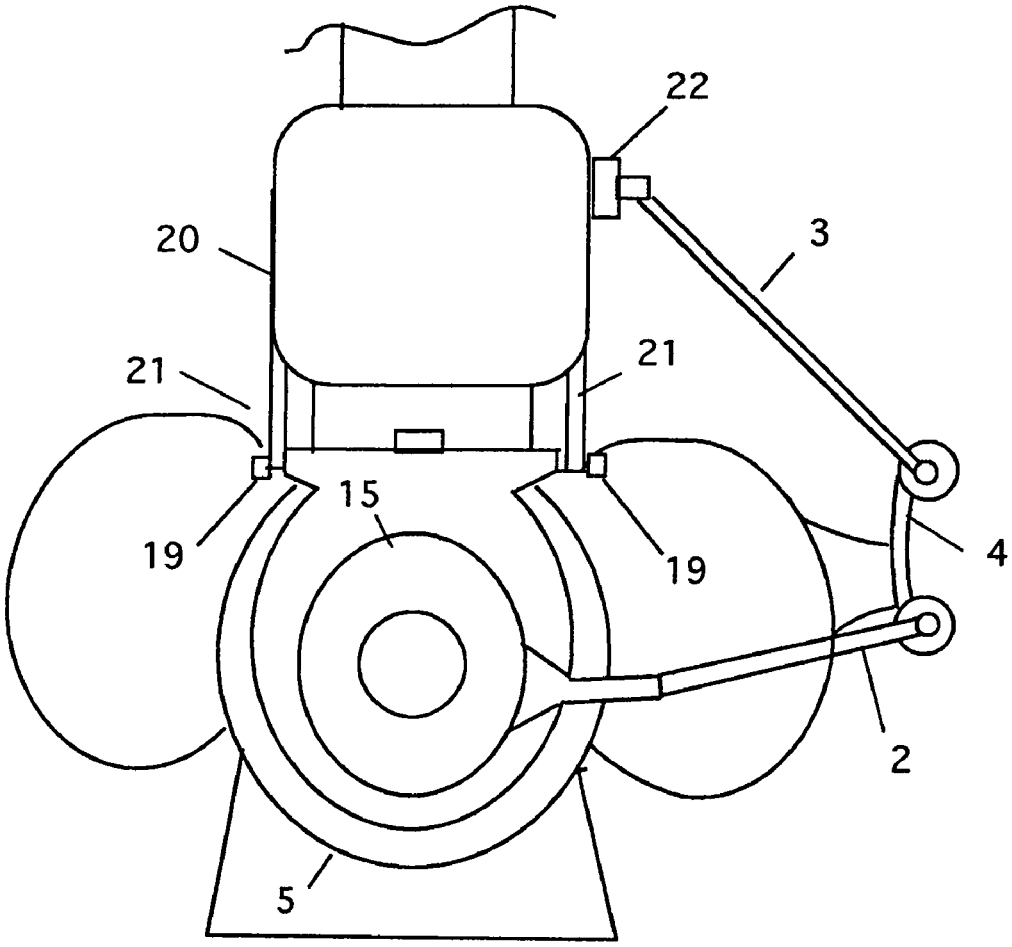
FIG. 3 is a rear view of the jet pump steering system lower portion, in place on a motor.

FIG. 3 is a rear view of the JPS system lower portion, in place on a motor. Here, the adaptor ring 5, the directional nozzle and reverse thrust cap are shown in relation to the lower unit 101*a* of the motor. Note the positions of cables 2 and 3 in making connections to the different components. Note also bracket 4, which is secured to the lower unit 101*a*. This bracket holds the cables 2 and 3 in the proper position.

Figure 4:
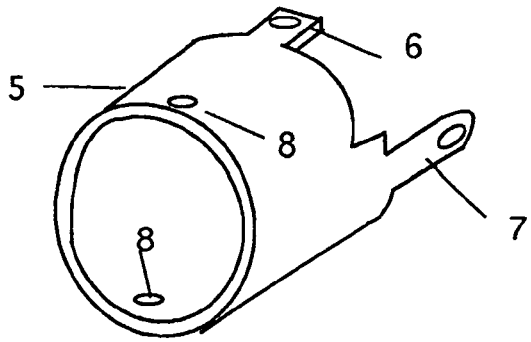
FIG. 4 is a perspective detail view of the adapter ring frame of the jet pump steering system.

FIG. 4 is a perspective detail view of the adapter ring frame of the JPS system. The adaptor ring 5 is used to attach the directional components of the JPS to the lower unit. The adapter ring 5 has two brackets 6 that connect the adapter ring to the lower unit 101*a*. See FIG. 2. The adapter ring 5 does not move after it is installed. Rather, it acts as a means for attaching the movable components of the system to the motor. The adapter ring 5 also has a bracket 7 that is used to secure the cable 2 as it feeds back to the directional nozzle 15. Finally, the adapter ring 5 has two holes 8 that are used to secure the directional nozzle 15, as discussed below.

Figure 5:
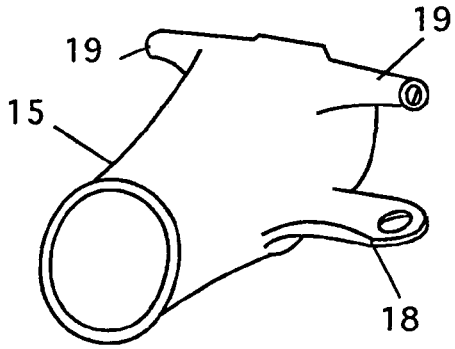
FIG. 5 is a perspective detail view of the directional nozzle of the jet pump steering system.

FIG. 5 is a perspective detail view of the directional nozzle of the JPS system. The directional nozzle 15 has a tapered body to allow for maximum efficiency in the jet flow. The directional nozzle 15 has two brackets 16 (see FIG. 2) that secure it to the adaptor ring 5 using bolts 17, or other common fasteners. A bracket 18 is formed on the side of the directional nozzle 15 to which the cable 2 is attached. Two ears 19 extend out of the top of the directional nozzle 15 as shown. These ears bolt the reverse thrust cap 20 in place (see FIG. 2). The directional nozzle 15 is designed to pivot side to side around the adapter ring 5. By pulling or pushing the cable 2, the directional nozzle 15 moves right or left. If this is done while the motor is operating, the movement of the directional nozzle 15 will cause the boat to steer left or right while the motor remains stationary.

Figure 6:
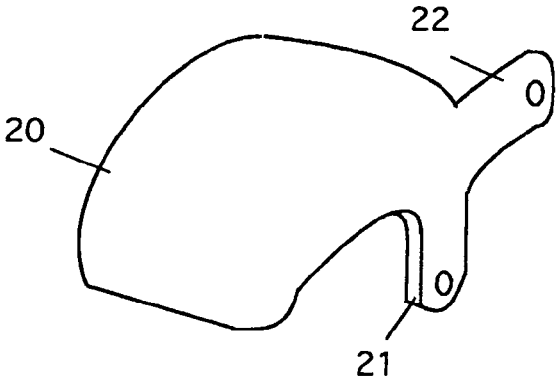
FIG. 6 is a perspective detail view of the reverse thrust cup of the jet pump steering system.

FIG. 6 is a perspective detail view of the reverse thrust cup 20 of the JPS system. In a jet drive boat, there is no propeller to reverse to reverse the thrust of the motor. Thus, the reverse thrust cup 20 is designed to move down over the output of the directional nozzle 15, which causes the jet output to strike the reverse thrust cup 20, which causes the boat to move in the reverse direction of normal thrust. The reverse thrust cup 20 is a curved member that has a pair of brackets 21 (see FIG. 3), which hook over the ears 19 on the directional nozzle 15. This allows the reverse thrust cup 20 to move in a vertical direction, up and down. The reverse thrust cup 20 is controlled by the cable 3 (see FIG. 2), which is secured to a bracket 22 that extends back from the reverse thrust cup 20 as shown. This, if cable 3 is pulled, the reverse thrust cup 20 is pulled up, which is the normal operating position. If cable 3 is pushed, the reverse thrust cup 20 is moved down into the reverse position.

In the preferred embodiment, there are two types of controls disclosed. The choice of control depends on a number of factors, including the size of the motor, the size of the boat, and the personal preferences of the operator. It is also possible to have both control systems installed and available for use on a single boat.

Figure 7:
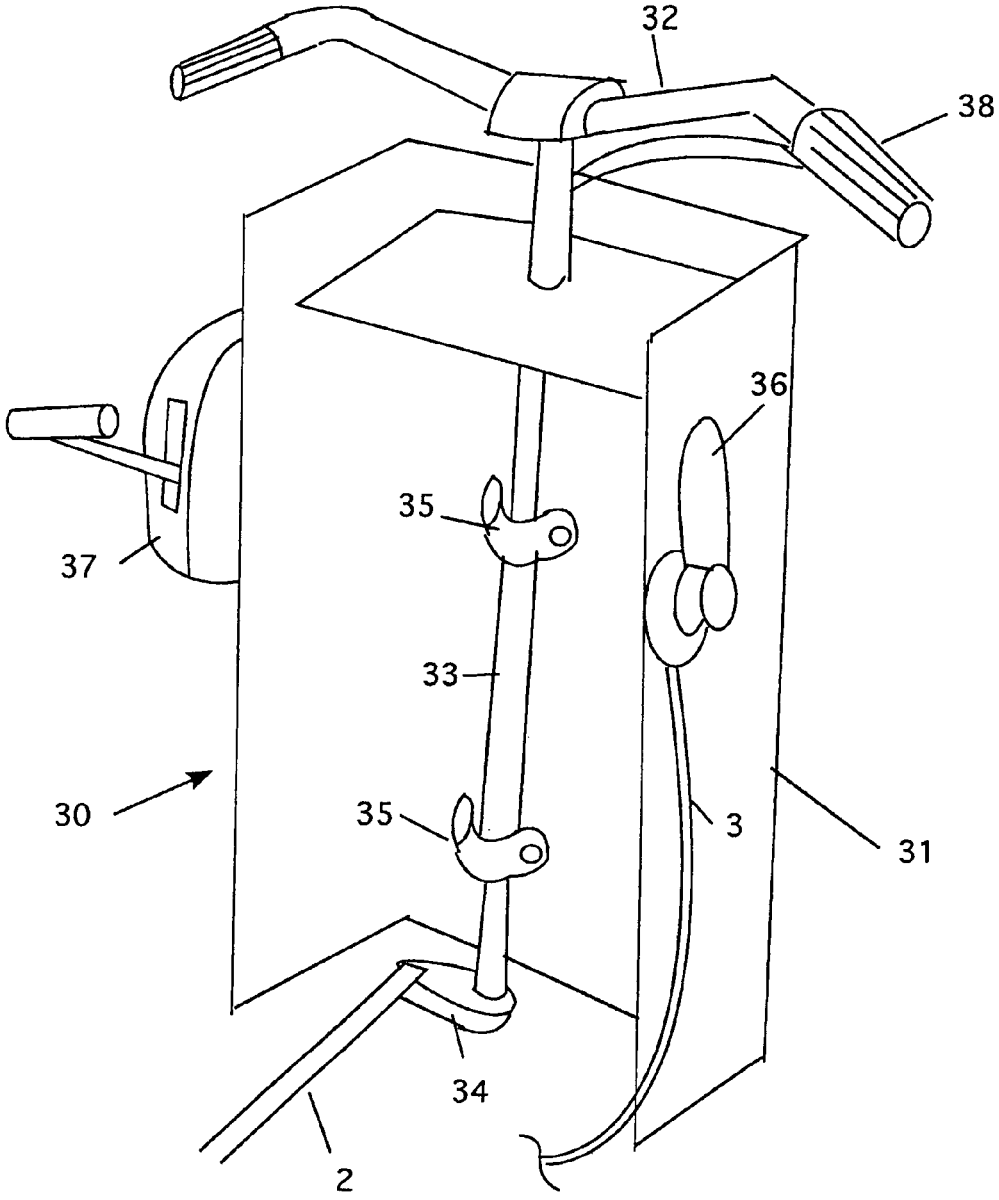
FIG. 7 is a perspective view of a handlebar steering control portion of the system.

FIG. 7 is a perspective view of a handlebar steering control portion 30 of the system. The handlebar steering control portion 30 consists of a support stand 31 that holds the unit in a convenient position and height for the user. The control has a handlebar portion 32 that is attached to a shaft 33. The shaft extends down through the support stand 31 until it connects to a horizontal connector 34. The connector 34 attached to cable 2 and to the shaft 33 such that as the shaft 33 is turned, it acts to pull or push the cable 2, which in turn, causes the directional nozzle 15 to turn, thereby steering the boat. The shaft is secured within the support stand by brackets 35 as shown. Of course, other means may be used in place of these brackets as well.

The reverse thrust handle 36 is attached to the support stand as shown. A lever connects to the cable 3 and operates the reverse thrust cup 20 by moving the lever back and forth. A speed control 37 can also be connected to the support stand as shown. Moreover, the speed control can be incorporated into one of the handles 38 of the handlebar 32. In this case, the speed control operates as the speed control on a motorcycle, or the tiller control, discussed below.

Figure 8:
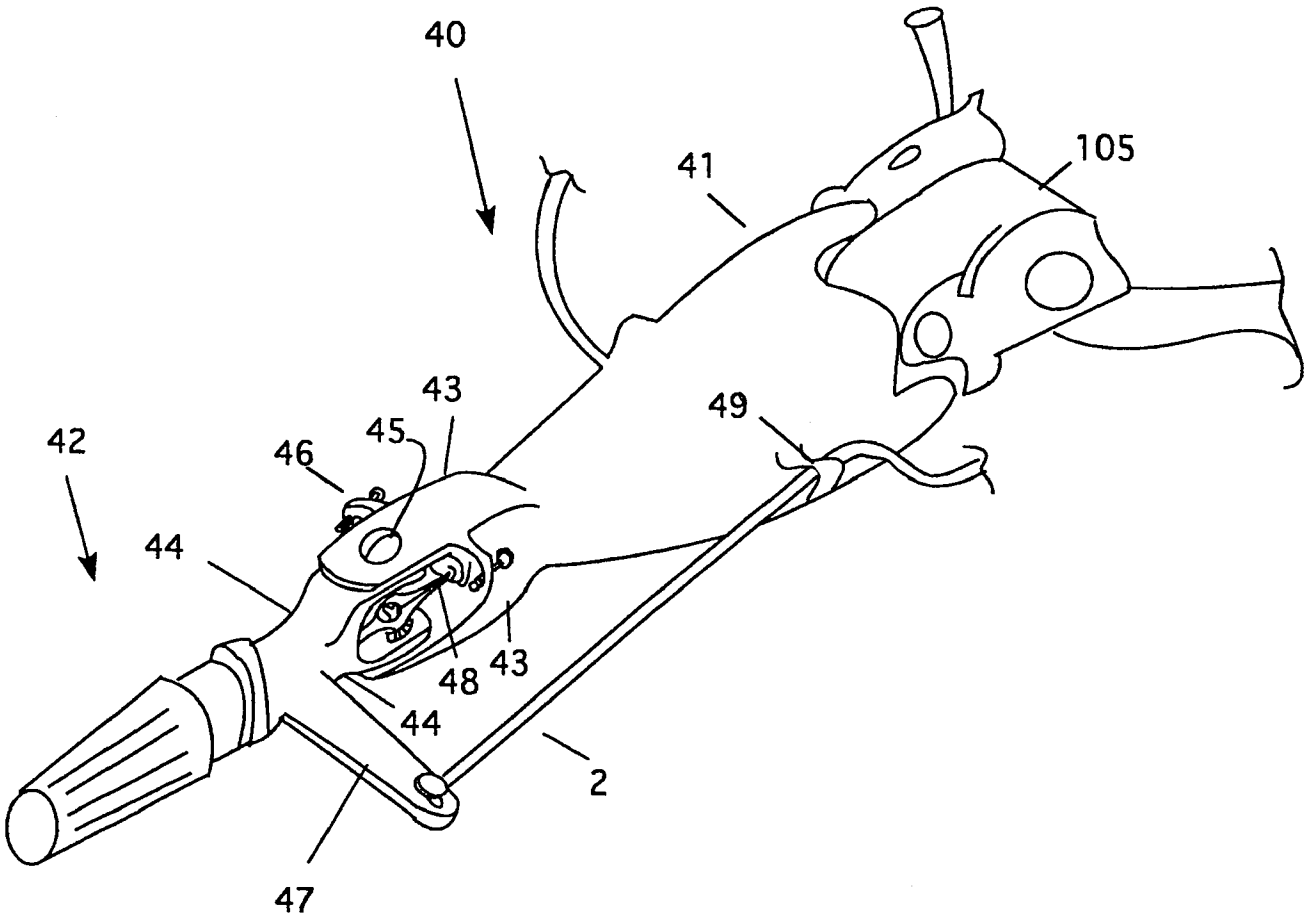
FIG. 8 is a perspective detail view of the steering tiller for the new steering system.

Ordinarily, the tiller is attached to the motor so that as the tiller is pushed from side to side, the motor is turned. The steering tiller for the instant invention, however, has a different structure. FIG. 8 is a perspective detail view of the steering tiller for the new steering system. In this system, the steering tiller 40 has a mounting arm 41, which is secured to the motor tiller mount 105. At the front of the mounting arm 41 is the steering control 42. As discussed below, the steering control 42 is attached to the mounting arm by two brackets 43 located on the mounting arm and two brackets 44 that are attached to the steering control 42. The brackets 43 and 44 are secured by fasteners 45. Linked in this way, the steering control is able to move back and forth while the mounting arm 41 remains stationary. Two adjustable stops 46 are attached to the steering control as shown. These stops limit the side-to-side movement of the steering control to a preferred range of 45 degrees of movement on each side of the centerline of the mounting arm. The stops are adjustable so that this angle can be set within a narrow range. A lever 47 is attached to the steering control as shown. Control cable 2 is attached to the lever 47. Now, as the steering control is moved from side to side, cable 2 causes the directional nozzle 15 to move from side to side. In this way, the boat can be steered using the tiller in much the same fashion as a standard tiller.

Throttle control is obtained by a universal joint 48, which allows the throttle mechanism to turn regardless of the position of the steering control 42.

In this embodiment, the reverse mechanism is handled by a lever attached to the motor, in much the same way as a normal reverse lever is used. Here, however, the reverse lever is connected to cable 3, which operates the reverse thrust cup 20. A cable stabilizer bracket 49 may be attached to the mounting arm 41 to support the cable 3 in a non-obstructive position.

Figure 9:
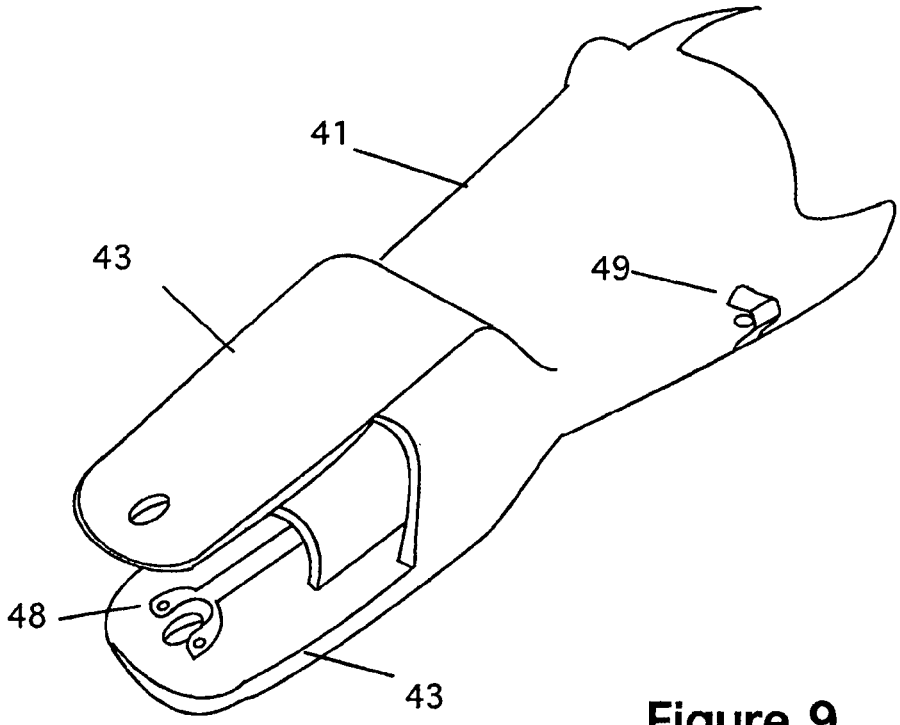
FIG. 9 is a detail view of a portion of the fixed portion of the tiller arm.

FIG. 9 is a detail view of a portion of the mounting arm 41. Here, the brackets 43 are shown as well as one-half of the universal joint 48. The cable stabilizer bracket 49 is also shown.

Figure 10:
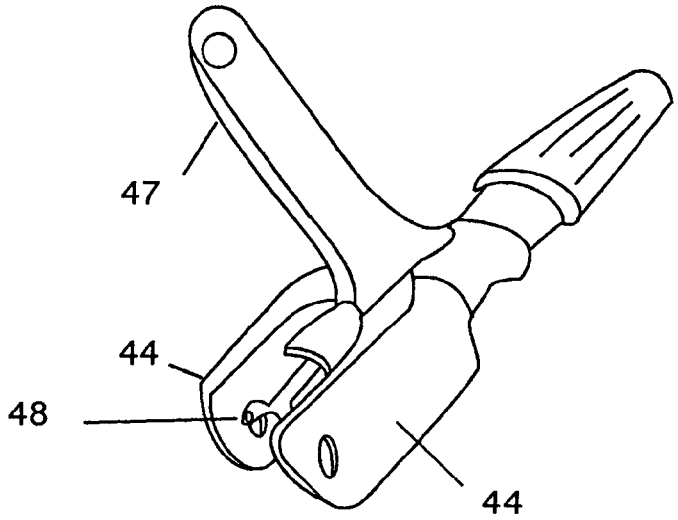
FIG. 10 is a detail view of the movable portion of the tiller arm.

FIG. 10 is a detail view of the steering control 42. This view shows the two brackets 44 that are attached to the steering control 42, as well as the lever 47, which is attached to the steering control as shown. This view also shows the other half of the universal joint 48.

Figure 11:
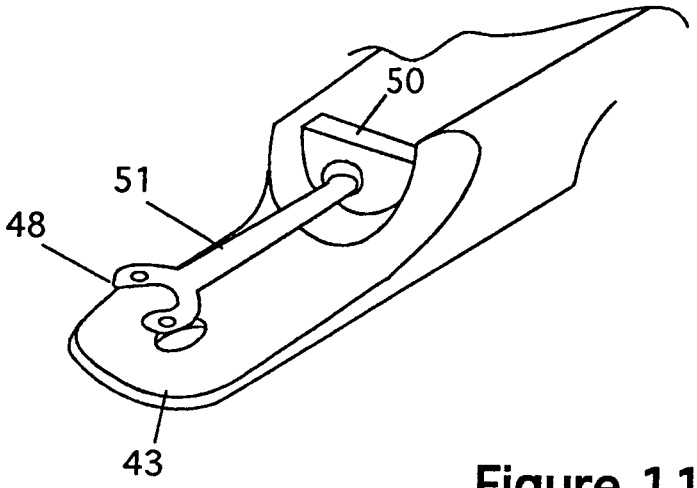
FIG. 11 is a detail view of the underside of the fixed portion of the tiller arm.

FIG. 11 is a detail view of the underside of the mounting arm 41. Note that a bearing 50 is installed on the underside of the arm to support the shaft 51 from the universal joint 48. Note that only one of the brackets 43 is shown in this view to allow the bearing 50 to be seen.

Figure 12:
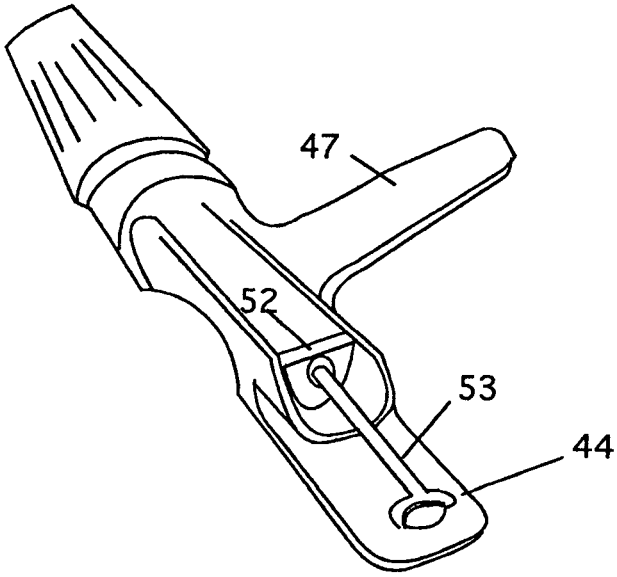
FIG. 12 is a detail view of the underside of the movable portion of the tiller arm.

FIG. 12 is a detail view of the underside of the steering control 42. As in FIG. 11, only one bracket 44 is shown. This allows the bearing 52 to be seen. This bearing supports the shaft 53 extending from the universal joint.

Figure 13:
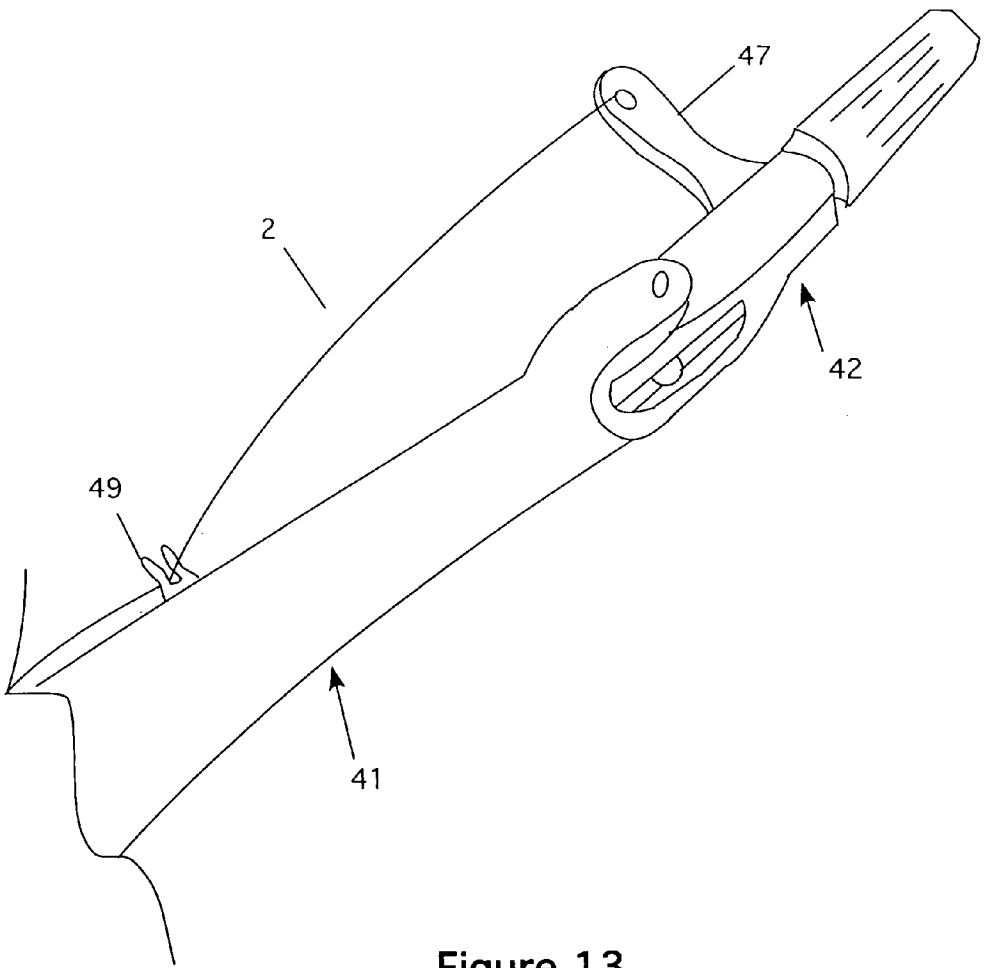
FIG. 13 is a perspective view of another embodiment of the tiller arm.

FIG. 13 is a perspective view of the modified tiller arm. In this view, the cable 2 is shown connecting to the lever 47. The cable 2 is also shown passing through another type of cable stabilizer bracket 49.

Figure 14:
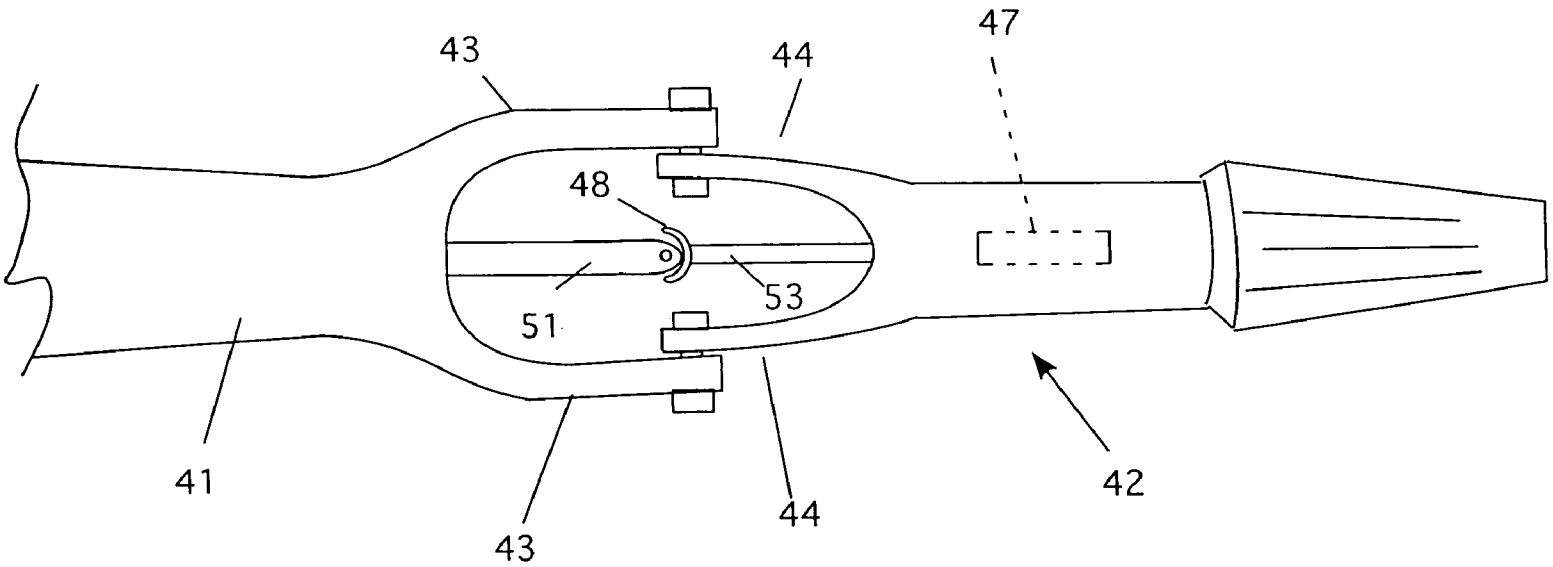
FIG. 14 is a bottom view of the embodiment of the tiller arm of FIG. 13.

FIG. 14 is a bottom view of the embodiment of the tiller arm of FIG. 13. This view shows the lever 47 and the universal joint 48 and the shafts 51 and 52.

Figure 15:
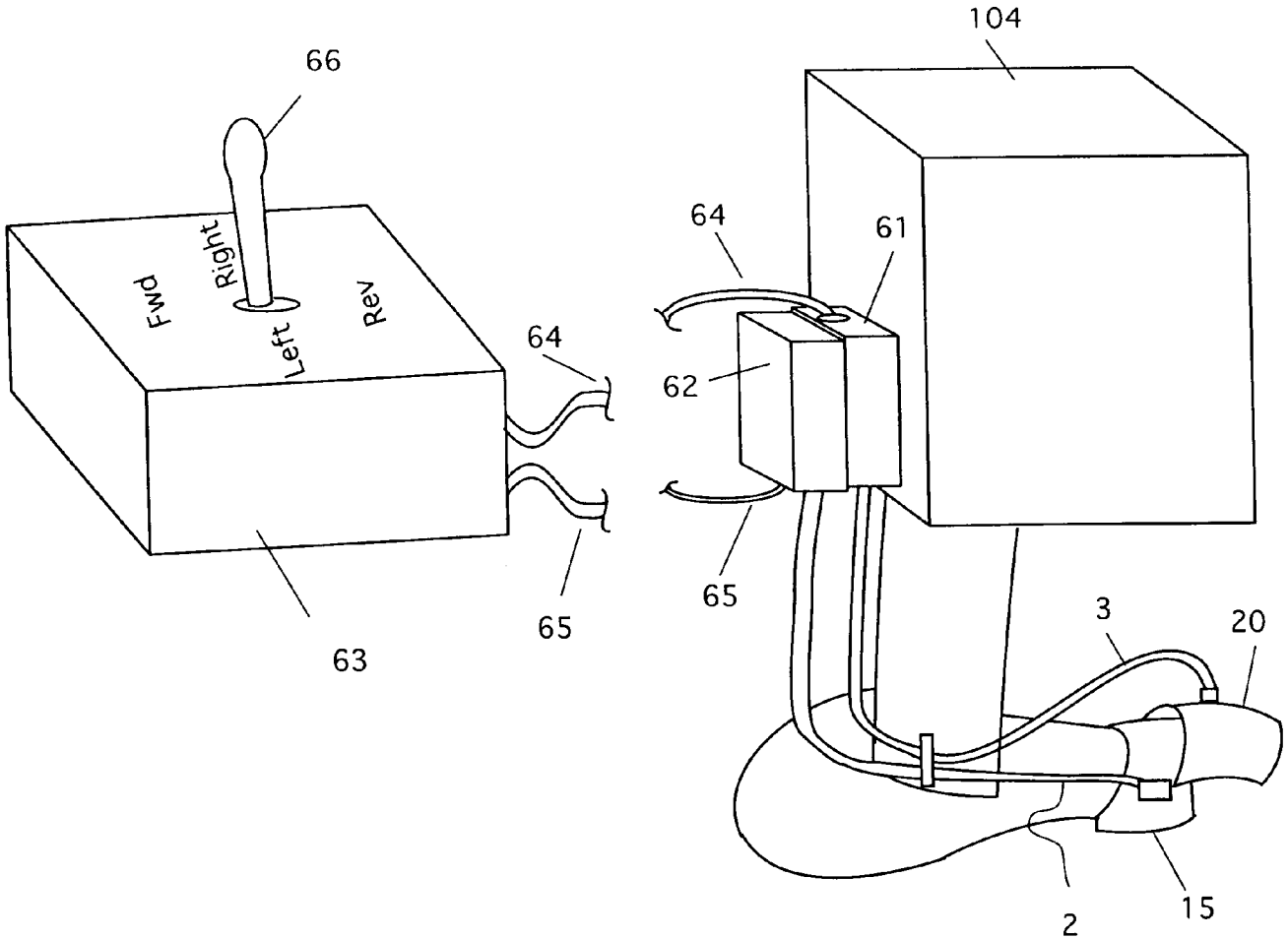
FIG. 15 is a perspective view of another embodiment of steering mechanism.

FIG. 15 shows another type of steering control. In this figure, a joystick is used to maneuver the boat. In this design, the operating components installed on the motor remain the same as discussed above. He only difference is the apparatus used to control the steering components. Thus, the directional nozzle 15, its cable 2, the reversing cup 20, and its cable 3 are shown mounted to the lower unit 101*a* of the motor 101 just as before. The difference is that the cables 2 and 3 now terminate in actuators 61 and 62 as shown. These actuators can be servo driven or by any other means known in the art. However, servos are the preferred method. A third servo can be attached (as well as a mechanical linkage) to the throttle so that when the joystick is pushed forward, the throttle is advanced.

Figure 16:
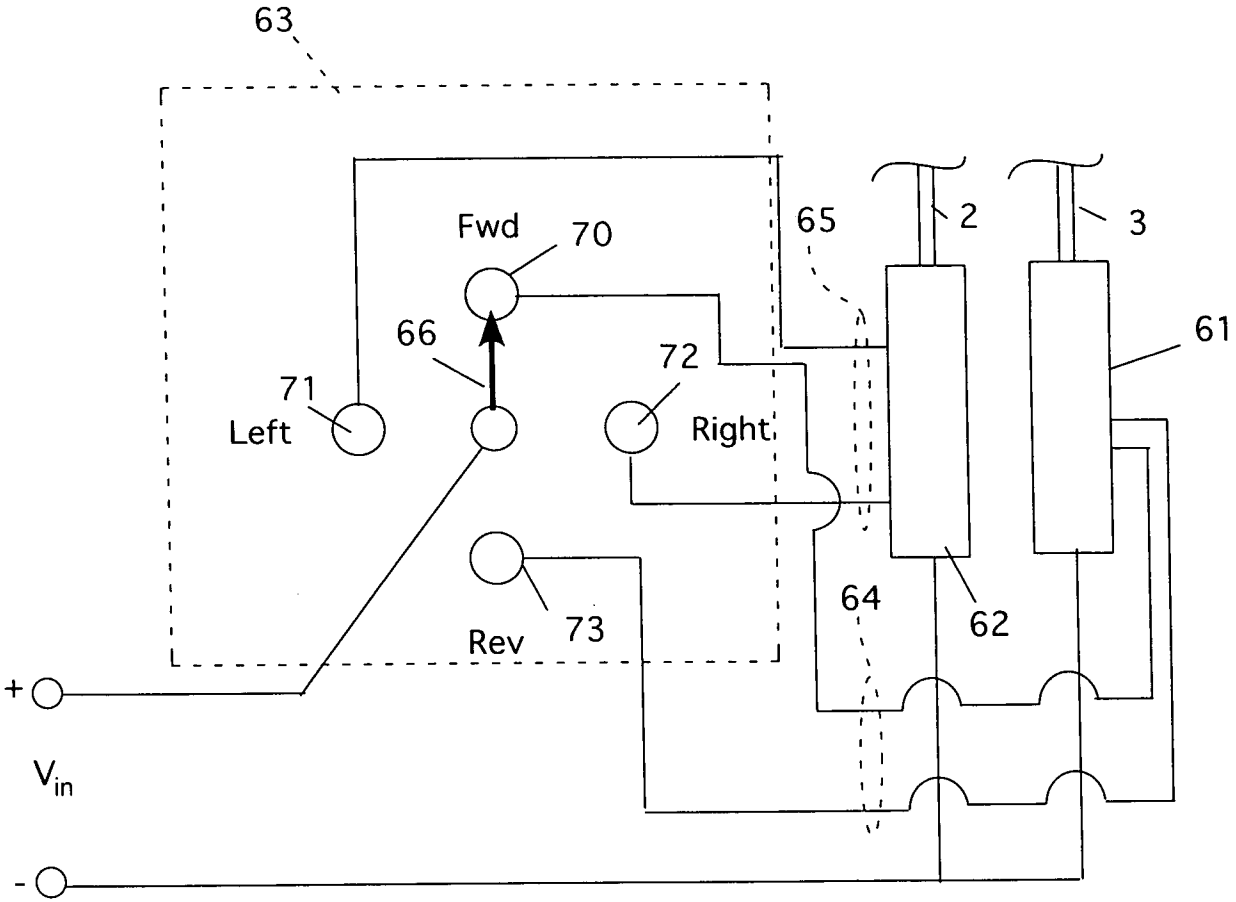
FIG. 16 is an electrical schematic diagram of the joystick controller circuit.

The actuators 61 and 62 are connected to a control box 63 by cables 64 and 65 as shown. The control box 63 has a joystick lever 66 that can be moved forward, back, left and right. Note that the control box 63 is marked with directions such as "fwd" for forward, "Rev" for reverse and "Left" and "Right" for steering left and right. In side the box 63 are switches 70, 71, 72 and 73 that are engaged when the handle 66 is moved, see FIG. 16. This figure shows that the system is powered by a power source $V_{in}$, such as a battery (not shown). When switch 70 is engaged it sends a signal to the actuator 61 to raise the revering cup 20. Similarly when switches 71 or 72 are engaged a signal is sent to actuator 62 to move the directional nozzle 15 to the left or right as desired. Finally, when switch 73 is engaged, it sends a signal to the actuator 61 to lower the revering cup 20. In this way, the boat can be steered quickly and easily with a minimum of motion by the operator and by a minimum motion by the steering system.

Figure 17:
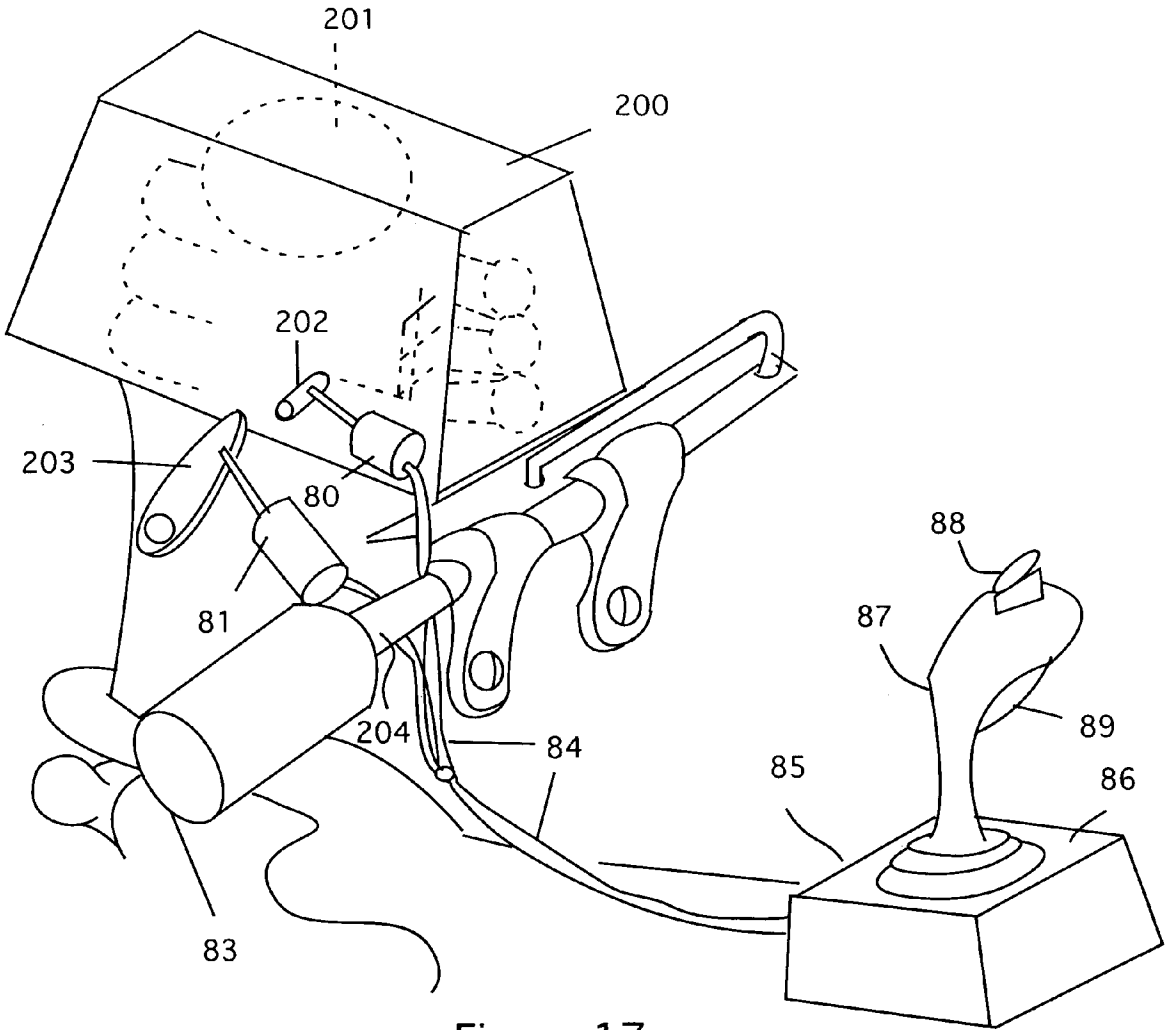
FIG. 17 is a perspective view of another embodiment of steering mechanism using a joystick on a conventional outboard motor.

FIG. 17 shows another embodiment in which a joystick is used to operate a conventional outboard. In this case, the joystick operates the throttle and the direction of the boat (forward and reverse and right and left). Note that unlike the system described above, this system works with motors that must be turned to steer the boat.

FIG. 17 shows a typical outboard motor 200 that has an engine 201 under a hood. The engine is controlled by a throttle lever 202, which normally attaches to a cable, which in turn attached to a lever, to control the speed of the engine. The motor 200 also has a transmission lever 203, which controls forward, reverse and neutral positions of the motor. This is typically attached to a cable that attaches to a second lever, which is used to set the direction (forward or reverse) of the boat. As discussed above, the side-to-side steering for such a motor is achieved by manually causing the motor to move from side to side. This can be done by a tiller arm, or by attaching a steering arm, which is controlled by a cable attached to a steering wheel. As the wheel is turned, the cable causes the steering arm to rotate the motor.

Here, all of the functions are accomplished using a joystick and servo motors. The throttle is controlled by a forward-reverse worm-drive electric servomotor 80, which is connected to the throttle 202. Similarly, the transmission is worked by a solenoid 81 that attaches to the transmission lever 203. Note that the solenoid has three positions, which correspond to the forward, reverse and neutral positions of the lever 203. Finally, a second servomotor 83, also a forward-reverse worm-drive electric servomotor, is attached to the steering arm 204 as shown. The servo 83 is designed to cause the motor 200 to move side to side, thereby steering the boat left or right.

Figure 18:
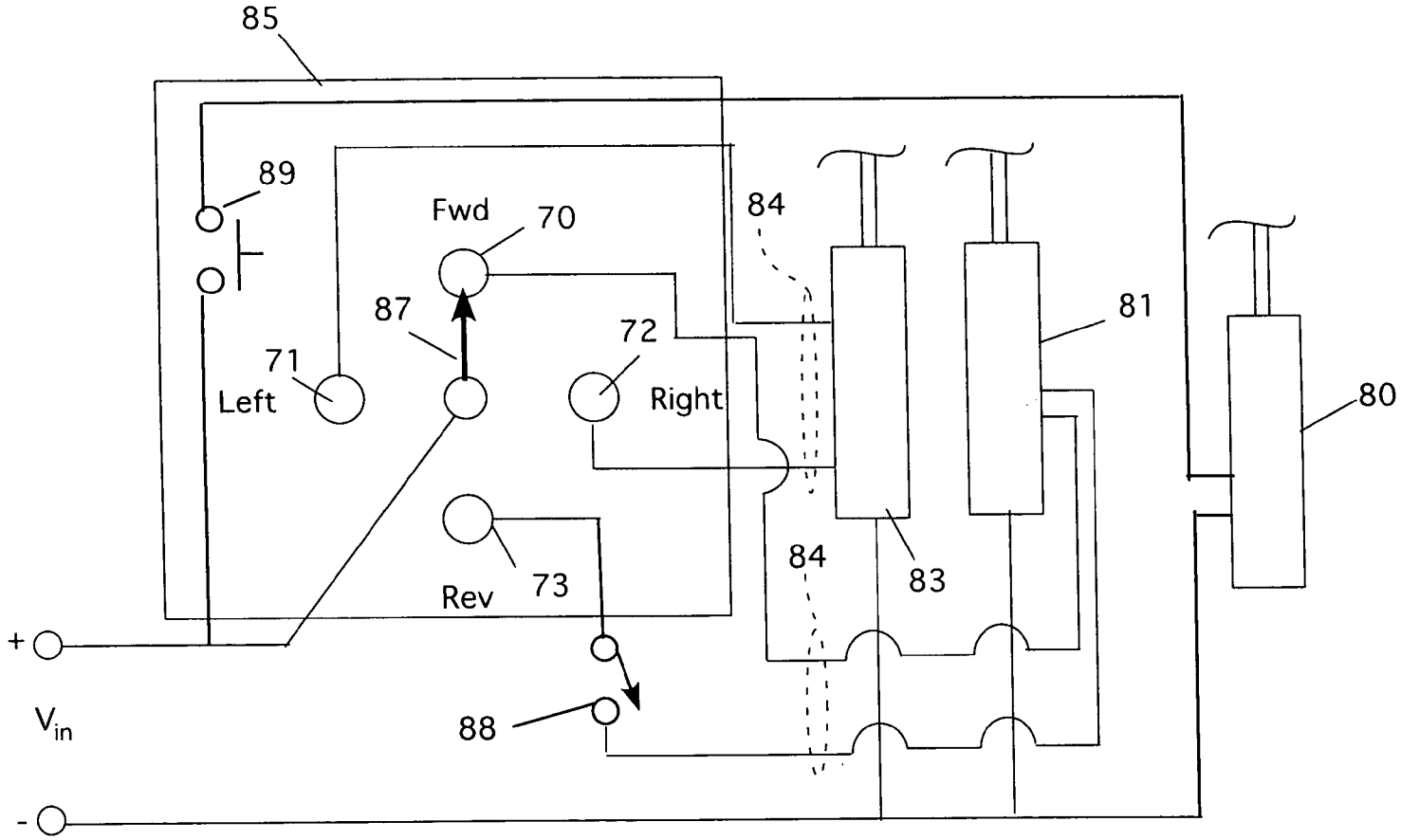
FIG. 18 is an electrical schematic diagram of the joystick controller circuit of FIG. 17.

All of the servomotors and solenoids are connected by electrical cables 84 to a joystick 85. The joystick 85 has a base 86, a stick handle 87, and a reverse lock button 88, and a throttle switch 89, as shown. The wiring for the joystick is shown in FIG. 18 and is similar to that shown in FIG. 16, using the same switches for forward/reverse, and left/right. Here, a switch is also needed for the throttle. This can be accomplished by a finger switch 89, or by other switching means common to the art. The joystick is connected to the servos and solenoid by cables 84 as shown. FIG. 18 is an electric schematic diagram of the joystick controller of FIG. 17. Note that, the switches and their configuration can be modified by those of ordinary skill in the art and that FIG. 18 is intended only to illustrate one possible configuration of many.

In normal operation, the device is operated much like a traditional steering system for a boat. In the case of the tiller, the operator holds the end of the tiller in the same manner as one would use a standard outboard motor tiller. The throttle is connected to the handgrip and is operated by twisting the handgrip. The boat is steered by moving the end of the tiller back and forth in a horizontal plane. Unlike the standard tiller, which when moved causes the entire motor to turn; the tiller of the instant invention causes the directional nozzle to move back and forth, which causes the boat to turn without moving the motor. In the case of the handlebar steering, turning the handlebars causes the cable to move the directional nozzle, thereby turning the boat. Again, the motor is not moved and the turning action does not require many rotations of a steering wheel. Finally, in the case of the joystick, moving the joystick handle causes the actuators to move the steering components.

In the case of the latter joystick embodiment, the joystick is used to control a conventional motor, which must be turned to steer the boat. As discussed above, this is accomplished using servomotors to control the various functions as needed.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A steering system for a boat having a convention outboard motor having a throttle lever, a transmission lever and a steering arm comprising:

a) a first servomotor, operably attached to said throttle lever;

b) a solenoid, operably attached to said transmission lever;

c) a second servomotor, operably attached to said steering arm; and d) a joystick controller, electrically connected to said first, second and third servomotors to control said boat, whereby said joystick controller has a first switch that controls said first servomotor to control the throttle lever, a second set of switches that engage said solenoid to move the boat in a forward or reverse direction by controlling said transmission lever, and a third set of switches to control said second servo motor to steer the boat from left to right by moving said steering arm.

2. The steering system of claim 1 wherein the first, second and second servomotors are forward-reverse, worm-drive electric servomotors.

3. The steering system of claim 1 further comprising a reverse lock switch, mounted on said joystick.

* * * * *